United States Patent [19]

Tontarelli

[11] Patent Number: 4,624,382

[45] Date of Patent: Nov. 25, 1986

[54] MULTI-PURPOSE CONTAINER WHICH MAY BE REDUCED IN HEIGHT

[76] Inventor: Sergio Tontarelli, Via Mordini Ciriaco, 37, Castelfidardo (AN), Italy

[21] Appl. No.: 578,913

[22] Filed: Feb. 10, 1984

[30] Foreign Application Priority Data

Feb. 11, 1983 [IT] Italy ..... 511/83[U]

[51] Int. Cl.[4] ..... B65D 7/24

[52] U.S. Cl. ..... 220/8; 220/83; 220/92

[58] Field of Search ..... 220/8, 19, 83, 401, 220/92

[56] References Cited

U.S. PATENT DOCUMENTS

| | | | |
|---|---|---|---|
| 60,603 | 12/1866 | Wickham | 220/92 |
| 3,436,928 | 4/1969 | Swerbinsky | 220/8 X |
| 3,687,330 | 8/1972 | Herolzer | 220/83 X |

FOREIGN PATENT DOCUMENTS

| | | | |
|---|---|---|---|
| 103286 | 12/1941 | Sweden | 220/8 |

*Primary Examiner*—Steven M. Pollard

*Attorney, Agent, or Firm*—Leonard Bloom

[57] ABSTRACT

This invention relates to a multi-purpose plastic container which may be reduced in height in that it is made up of three cylindrical sections of successively diminishing diameter which means that they can fit into one another like a telescope.

Furthermore, the container is fitted with a semi-circular handle and a basin or plate which may be attached underneath by means of a latching hook.

5 Claims, 5 Drawing Figures

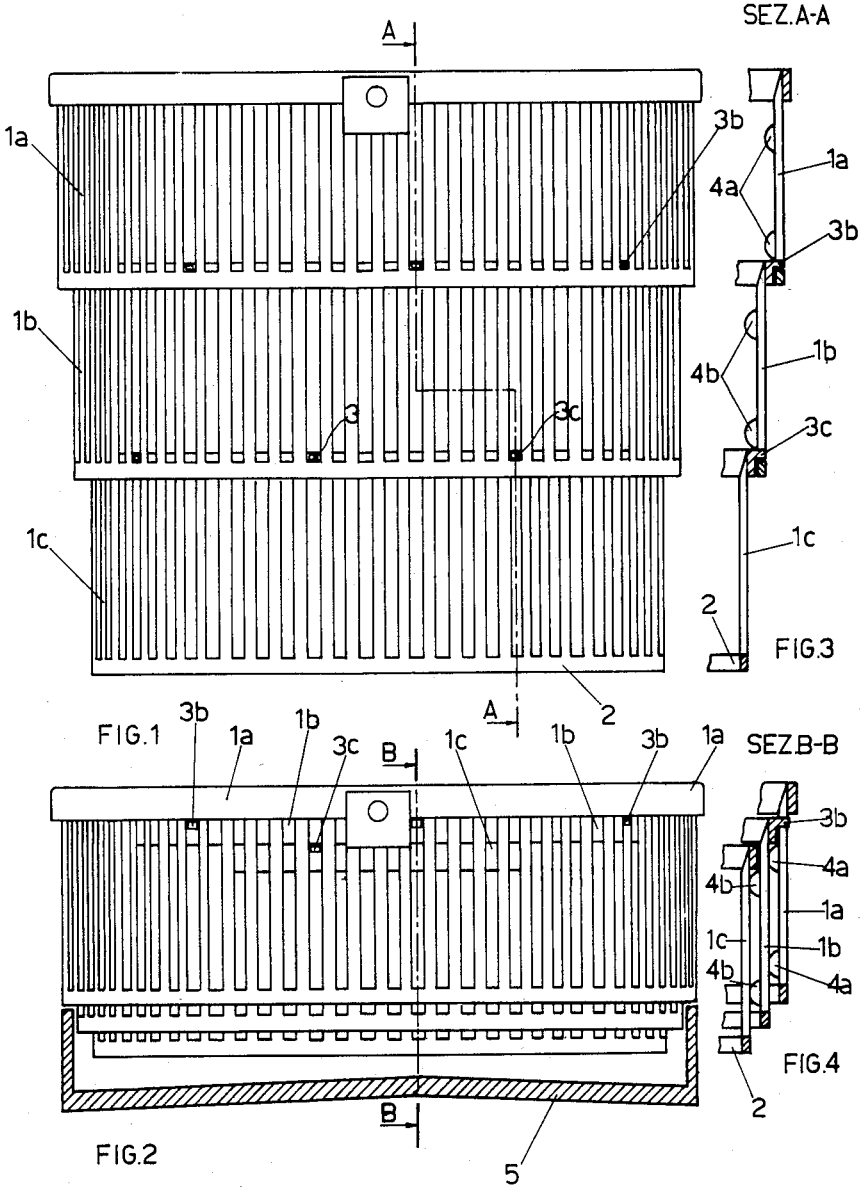
TAV.I-2

MULTI-PURPOSE CONTAINER WHICH MAY BE REDUCED IN HEIGHT

This Application for Industrial Utility Patent has for its object a multi-purpose plastic container which may be reduced in height in that it is made up of three cylindrical sections of successively diminishing diameter, which means that they can fit into one another like a telescope.

A plate or basin may be attached underneath the container by a flexible fitting in order to collect any water that may run out when wet objects are placed in it or when it is used as a flower pot stand.

Furthermore, the container is fitted with a semi-circular handle, which may easily be removed, in the ceter of which is an eye for the insertion of an arm, hooked at both ends, thus allowing the container to be hung from a horizontally slung line.

The accompanying drawings are for a clearer illustration but exemplify only one preferred embodiment of the herein described invention wherein;

FIG. 1 is a view of the container fully extended in accordance with the instant invention;

FIG. 2 is a view of the container when reduced to its minimum size in accordance with the instant invention;

FIG. 3 is a section of the side wall of the container along the the vertical plane A—A of FIG. 1;

FIG. 4 is a section of the side wall of the container with the vertical plane of FIG. 2;

Figure 5:
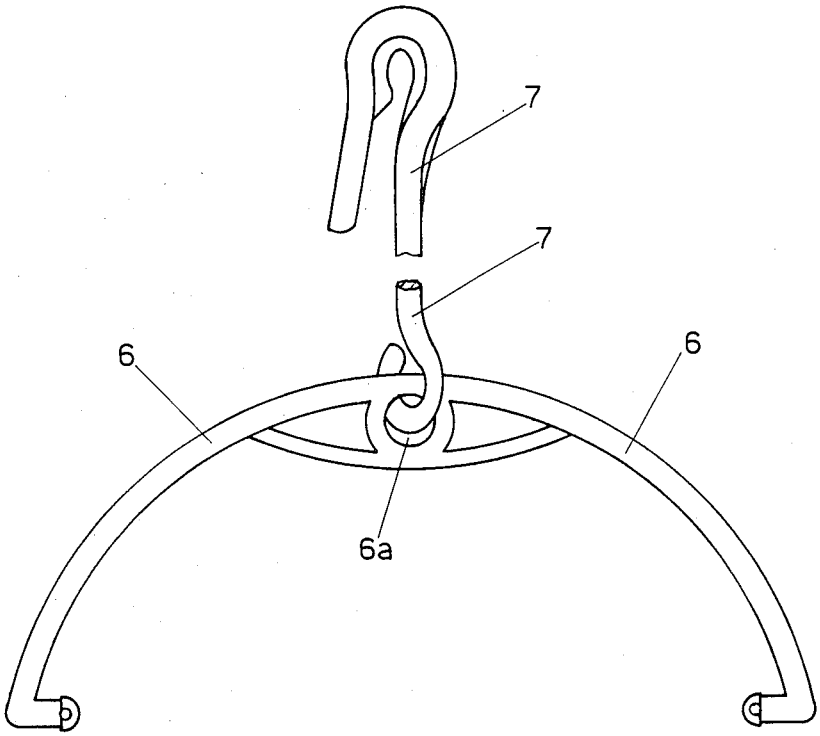
FIG. 5 is a view of the handle with aforesaid hooked arm.

With reference to FIGS. 1, 2, 3 and 4, the article, object of the instant invention, consists of a container made up of three cylindrical sections of successively diminishing diameter, designed to fit into one another like a telescope.

Each cylindrical section molded in one piece of plastic has a top perimetrical band which is connected to its lower edge by a plurality of thin, vertical parallel strips; the gap between each strip being equal to the width of the strip itself.

The bottom section (1*c*) obviously has a base (2), which in the preferred embodiment, is like a grid in that it is a lattice of concentric rings intersected by a number of radial lines.

At regular intervals along the edge of the top perimetrical band of the middle section (1*b*) and of the bottom section (1*c*) there are small protruding teeth (3*b*) and (3*c*) which fit and slide respectively inside the vertical grooves found in the walls of section (1*a*) and section (1*b*).

The top section (1*a*) and the middle one (1*b*) are provided with stop catches (4*a*) and (4*b*). The top edge of the middle section (1*b*) and of the bottom one (1*c*) slide over these stop catches when the container is being extended, thanks to the flexing action of the strips.

To be more precise, the inside walls of the section (1*a*) and section (1*b*) are provided with two series of stop catches (4*a*) and two series of stop catches (4*b*), one series on a horizontal plane immediately below the aforesaid top perimeterical band of each section, the others on a horizontal plane immediately above the same perimetrical band. The first series is designed to act against the downwards sliding movement of the section with the smaller diameter into the one with the larger diameter, whilst the second series prevents the section with the largest diameter from sliding down over the outside of the smaller section.

Underneath the base (2) of the section (1*c*) a plate or basin (5), seen in section in FIG. 2, may be attached. Said plate or basin is fitted with pincer hooking elements, not illustrated, which clip onto the grid-like base (2).

Finally, a semi-circular plastic handle (6) may be attached to the outside of the section (1*a*), in the center of which is an eye (6*a*) for the insertion of a small rod (7) with hooked ends thus allowing the container to be hung from a horizontally slung line.

Being able to hang the container up is particularly convenient if it is going to be used for holding clothes, pegs.

In conclusion it should be noted that the realization of the regularly spaced vertical strips, the gap between each strip being equal to the width of the strip itself, was chosen above all for technical and functional reasons rather than aesthetical ones in that they permit the rapid assembly of the three cylindrical sections without having to have precise points of reference. This is on account of the fact that the aforementioned teeth regardless of how they are put together immediately find a groove to accomodate and guide them.

I claim:

1. Multi-purpose container which may be reduced in height characterized by three cylindrical sections of successively diminishing diameter which means that they can fit onto one another like a telescope, characterized by the fact that each cylindrical section moulded in one piece of plastic, has a top perimetral band which is connected to its lower edge by a plurality of thin, vertical parallel strips; the gap between each strip being equal to the width of the strip itself, further characterized by the fact that at regular intervals along the edge of the middle and bottom sections there are small protruding teeth which fit and slide respectively inside the vertical grooves found in the walls of the top section and middle section.

2. The multi-purpose container as claimed in claim 1 further characterized by the fact that the inside wall of all except the bottommost sections are provided with each series parallel to the other, the first series above the second series on a horizontal plane immediately under the top perimetrical band of each section, whilst the second series of stop catches lie on a horizontal plane immediately above the same perimetrical band, whereby in combination with the protruding teeth prevents the section with the largest diameter from sliding down over the outside of the smaller section and provides structural support for the container.

3. A multi-purpose container, which may be reduced in height, comprised of section means of successively diminishing size each such section means having interior and exterior surfaces, a perimetrical band provided with top and bottom portions and each said section means further having a plurality of parallel vertical strips connecting the top portion of the perimetrical band with the bottom portion of the perimetrical band each such strip being provided with a vertical indentation; a first stop catch positioned in a substantially upper part of each said vertical indentation said stop catch further being on the same horizontal plane as the other first stop catches; a second stop catch, positioned below the first stop catches in a substantially lower part of each said vertical indentation said stop catch further being on the same horizontal plane as the other second stop catches; said vertical strips, vertical indentation, first stop catches and second stop catches all being further positioned on said sections interior surface; each section further having a plurality of teeth protruding from the top portion of the perimetrical band and positioned at regular intervals on the exterior surface of each section whereby said teeth may be received and carried by the said vertical indentations; said container further having a grid-like, a basin positioned immediately below said base and a means for attaching said basin to said base and a handle means for carrying said container secured on the exterior of the uppermost section of said container, an eye positioned in the center of the said handle means and a rod means with hooking ends adapted to be received in said eye means whereby the container may be hung on a horizontally slung line.

4. The multi-purpose container of claim 3 wherein the combination of the vertical indentations, protruding teeth and stop catches provide support for the container and prevents each of its sections from rotating reciprocally.

5. A multi-purpose container comprised of sections of successively diminishing size of a telescopic nature which is self supporting and which can be utilized in a fully expanded, collapsed or any semi-expanded position wherein each said section is molded in one piece of plastic and each said section having a top perimetrical band with a lower edge, the said top band being connected to said lower edge by a plurality of parallel vertical strips each provided with an indentation upon said sections interior wall; the gap between each strip being equal to the width of the strip itself; and each said section having protruding teeth positioned at regular intervals along the edge of all except the top sections whereby said teeth fit and slide respectively inside the vertical indentations found in the walls of all except the bottommost section.

* * * * *